US005271604A

United States Patent [19]

de Castro et al.

[11] Patent Number: 5,271,604

[45] Date of Patent: Dec. 21, 1993

[54] SUPPORT STRUCTURE FOR LIFTING TANKS WITH ROOF COLUMN SUPPORTS

[76] Inventors: Bruno de Castro; Murali S. Iyengar, both of 235 SW. LeJeune Rd., Miami, Fla. 33134

[21] Appl. No.: 945,310

[22] Filed: Sep. 15, 1992

[51] Int. Cl.[5] ..... B66F 1/08

[52] U.S. Cl. ..... 254/89 H

[58] Field of Search ..... 254/89 H, 89 R, 105, 254/108-111, 1, 93 R, 93 H, 423, 133

[56] References Cited

U.S. PATENT DOCUMENTS

| | | | |
|---|---|---|---|
| 2,958,508 | 11/1960 | Martinez | 254/89 H |
| 3,073,573 | 1/1963 | Haskins | 254/89 H |
| 3,131,908 | 5/1964 | Payton | 254/89 H |
| 3,211,427 | 10/1965 | Bristow | 254/89 H |
| 3,235,956 | 2/1966 | Heathcote et al. | 254/89 H |
| 3,269,705 | 8/1966 | Heathcote et al. | 254/89 H |
| 3,881,687 | 5/1975 | Johansson | 254/89 H |
| 4,807,851 | 2/1989 | de Castro . | |
| 4,930,750 | 6/1990 | de Castro . | |

*Primary Examiner*—Robert C. Watson
*Attorney, Agent, or Firm*—J. Sachelima

[57] ABSTRACT

An apparatus and method for lifting tanks including supporting roof columns including the temporary installation of column support assemblies to those columns to permit cutting them at a sufficient distance from the bottom to allow a reinforced U-shaped support structures to be placed under the columns. A lifting device is placed below the U-shape support structure and in cooperation with wooden logs in criss-crossed arrangement, the structure is blocked up and down. The U-shaped support structures are interconnected to each other with rails that are soldered to the bottom of the tank thereby lifting the bottom simultaneously with the lifting of the columns and roof. The present apparatus and method is to be used in conjunction with lifting apparatus and methods associated with the outer peripheral wall of the tank.

3 Claims, 4 Drawing Sheets

SUPPORT STRUCTURE FOR LIFTING TANKS WITH ROOF COLUMN SUPPORTS

BACKGROUND OF THE INVENTION

1. Field of the Invention

The present invention relates to support structures for lifting tanks, and more particularly, to such structures that are used to lift tanks that have column supports.

2. Description of the Related Art

Applicant believes that the closest reference corresponds to U.S. Pat. Nos. 4,807,851 and 4,930,750 issued to one of the applicants here, Bruno de Castro. However, it differs from the present invention because the matters described in these patents do not cover the larger tanks that utilize columnar internal support. This has been a problem in trying to utilize the patented process and apparatus for these larger tanks.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an apparatus and lifting tank method that can be readily adapted to be used with tanks that use columnar support members so that the entire tank, including its bottom can be lifted with minimum deflections.

It is another object of this present invention to provide an apparatus and method for lifting tanks with column support that are dependable and safe.

It is still another object of this present invention to provide an apparatus and method for lifting tank with column support that can be readily used with minimal interference with the structure of the tank being lifted.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5-A is a top view of the area where one of the support structures is positioned with connecting rails perpendicularly disposed with respect to the structure.

FIG. 6-A is a top view of a typical tank with supporting columns and a representation of the support structures associated with each column and interconnected with rails that are soldered to the bottom to be lifted along with the column.

DETAILED DESCRIPTION OF THE PREFERRED EMBODIMENT

Figure 1:
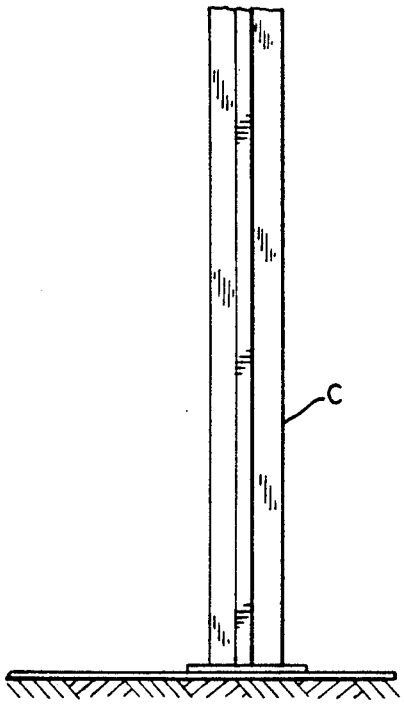
FIG. 1 represents a partial elevational view of a typical internal column support of a tank.
Figure 2:
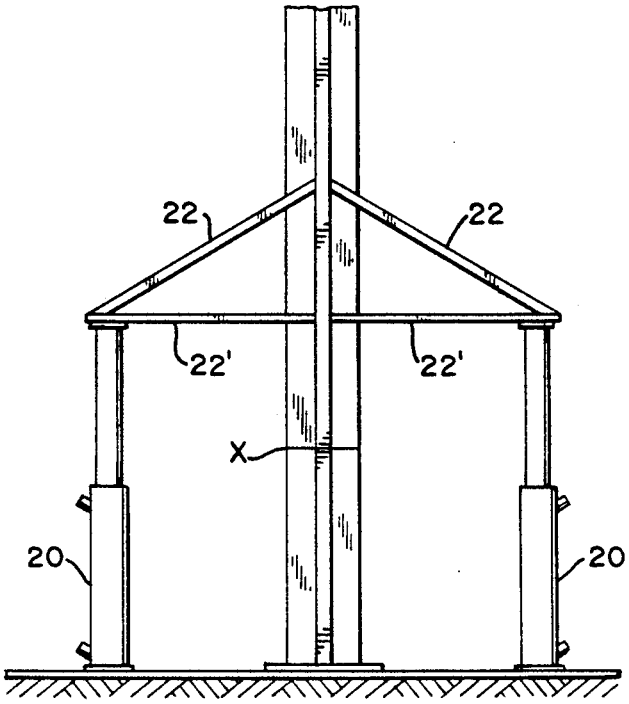
FIG. 2 shows the column represented in FIG. 1 temporary supports that permit a cross-sectional cut.

The present invention includes the apparatus and method for lifting tanks T with columns C disposed within the tank to support its roof R and the apparatus used to accomplish it. The tanks need to be prepared through the installation of the apparatus which includes an inverted U-shaped support structure 100 for each one of the columns C and connecting rails 120 that are welded to the bottom B of tank T and also rigidly attached to U-shaped support structures 100. Through the use of lifting devices, preferably pneumatic jack members 50, support structures 100 are lifted pushing upwardly columns C and roof R as well as lifting bottom B which is rigidly attached to longitudinally extending flat bottom surface 122 of the rails 120. A number of other equivalent lifting devices can also be used, such as mechanical and hydraulic jack assemblies, pressurized air bags, etc. Lifting the bottom of the tank, permits a maintenance crew to do their job repairing the tank and preparing the soil upon which the tank will rest.

Figure 3:
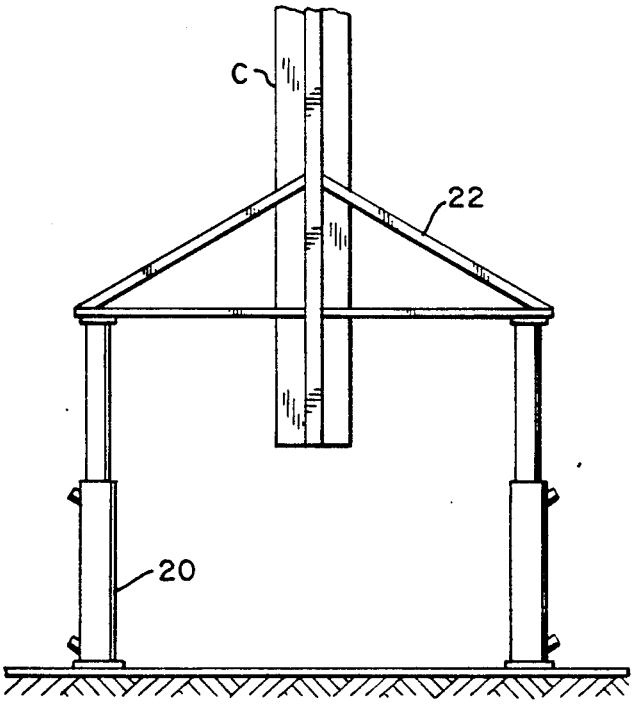
FIG. 3 shows the column of the previous figures with the part of the column removed.
Figure 4:
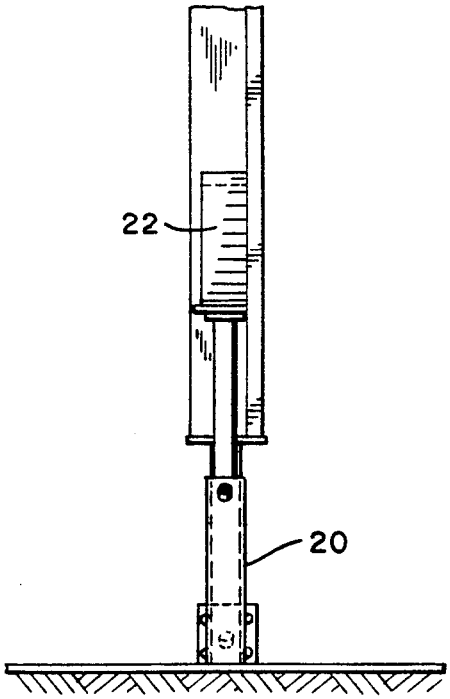
FIG. 4 shows the column represented in the previous figures with the support structure subject of the present application positioned underneath to support the column.
Figure 7:
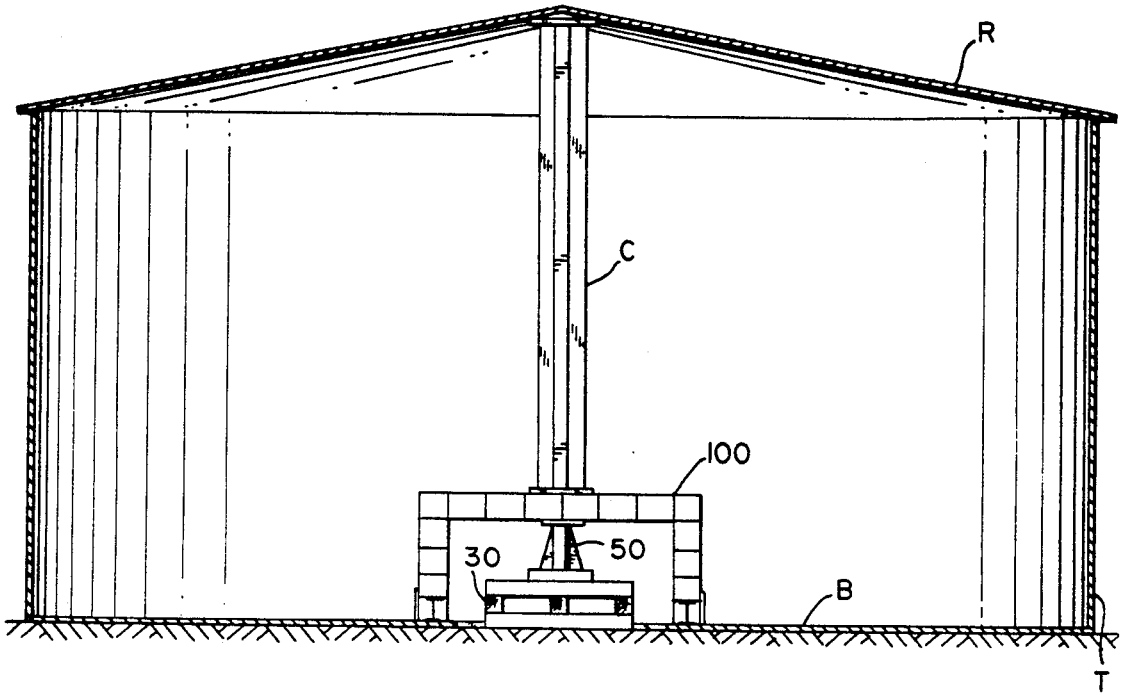
FIG. 7 illustrates a partial view of the support structure where a section of the bottom of the tank has been cut-off.

Referring now to FIGS. 1 through 4, the process of preparing a column C inside a typical T tank is described. Column C is shown in FIG. 1 and it support the roof (not shown) of the tank. Refer to FIG. 7 where roof R is shown. The first step requires the use of support assemblies 20 which are preferably implemented with mechanical jacks but any other tool can be used if it provides a sufficiently sturdy support. Supporting link members 22 and 22' (diagonal and horizontal) are rigidly mounted (typically through welding) to column C. In the preferred embodiment, member 22 extends diagonally with respect to column C and rests on the upper surface of horizontal support link member 22'. Horizontal support link member 22' extends outwardly and perpendicularly with respect to column C. Also, member 22' is preferably welded to column C and to diagonal support link member 22. The underside of member 22' rests on top of the uppermost end of support assembly 20. Once support assembly 20 has been installed, column C is transversally cut at "X" resulting in what is illustrated in FIG. 3. At this point, wood logs 30 are positioned (blocked up) in criss-crossed arrangement (see FIG. 5) to provide support to lifting device 50 which in the preferred embodiment is an inverted pneumatic jack such as the one described in U.S. Pat. Nos. 4,807,851 and 4,930,750. Other lifting devices, such as pressurized pneumatic bags and equivalent devices, can be used as lifting devices 50 for this task.

Figure 5:
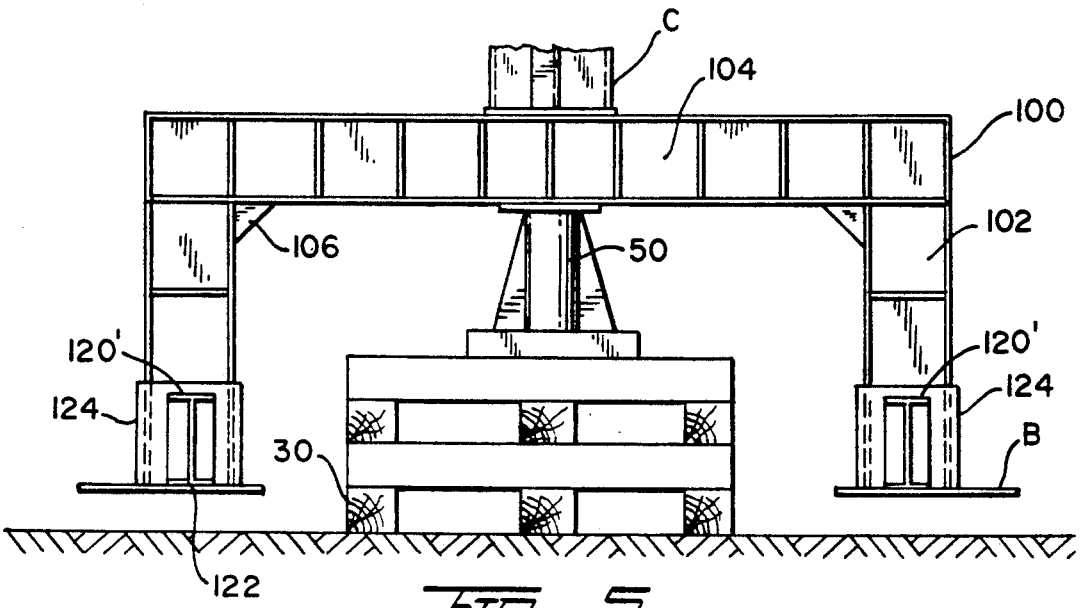
FIG. 5 shows a hydraulic jack used to lift the support structure and the bottom of the tank which is soldered to the rail that connects the support structures associated with each column.
Figure 5A:
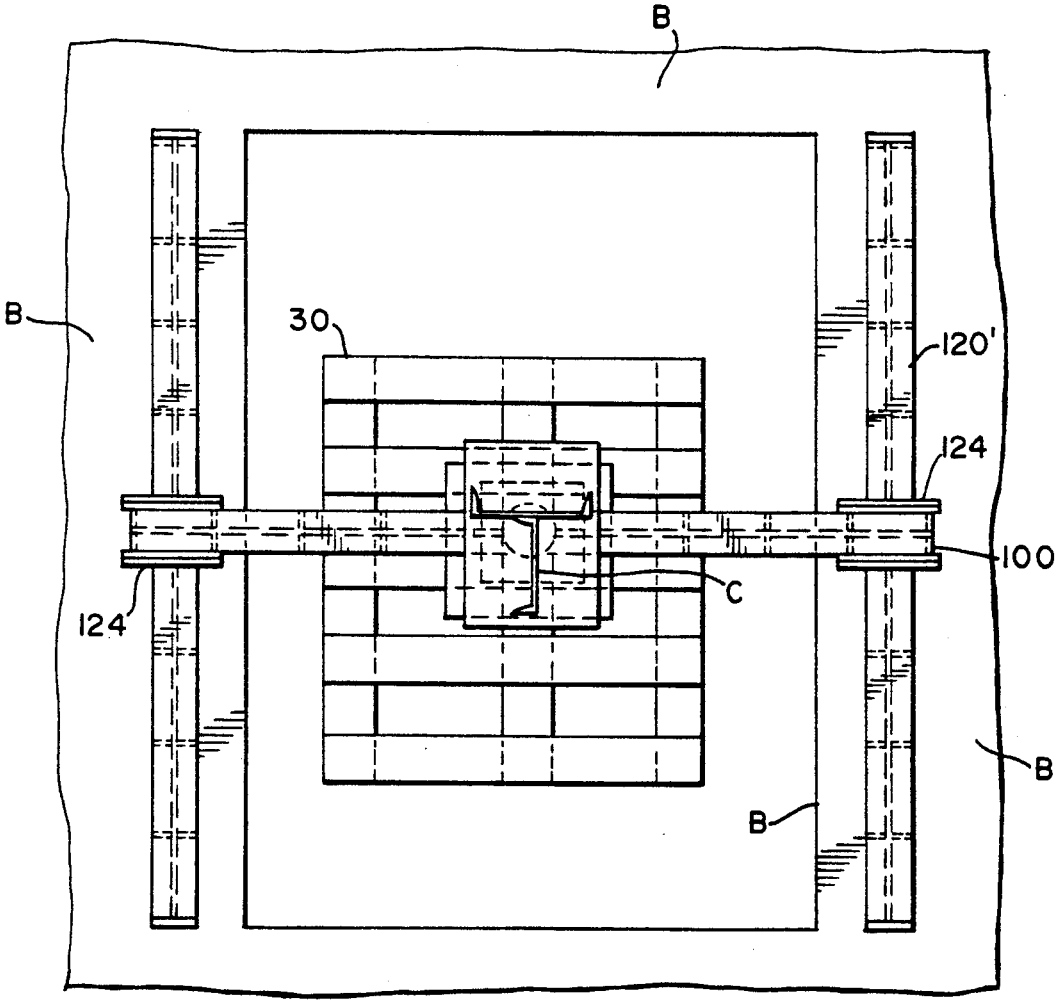
Figure 6:
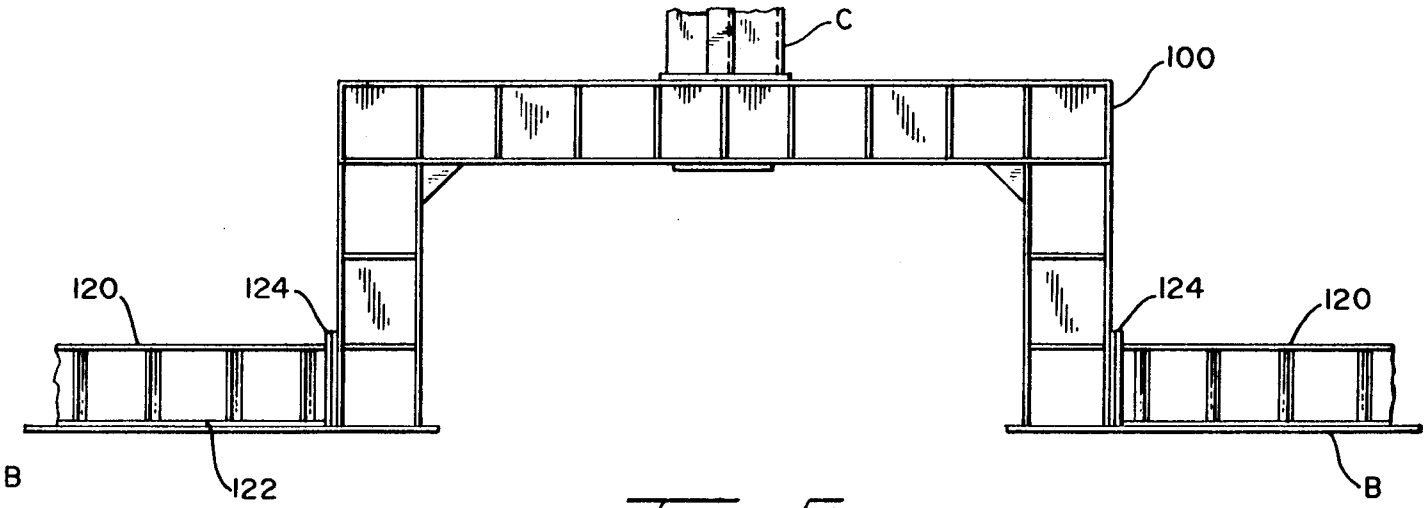
FIG. 6 is an elevational view of the support structure in position to be lifted by a hydraulic jack assembly.
Figure 6A:
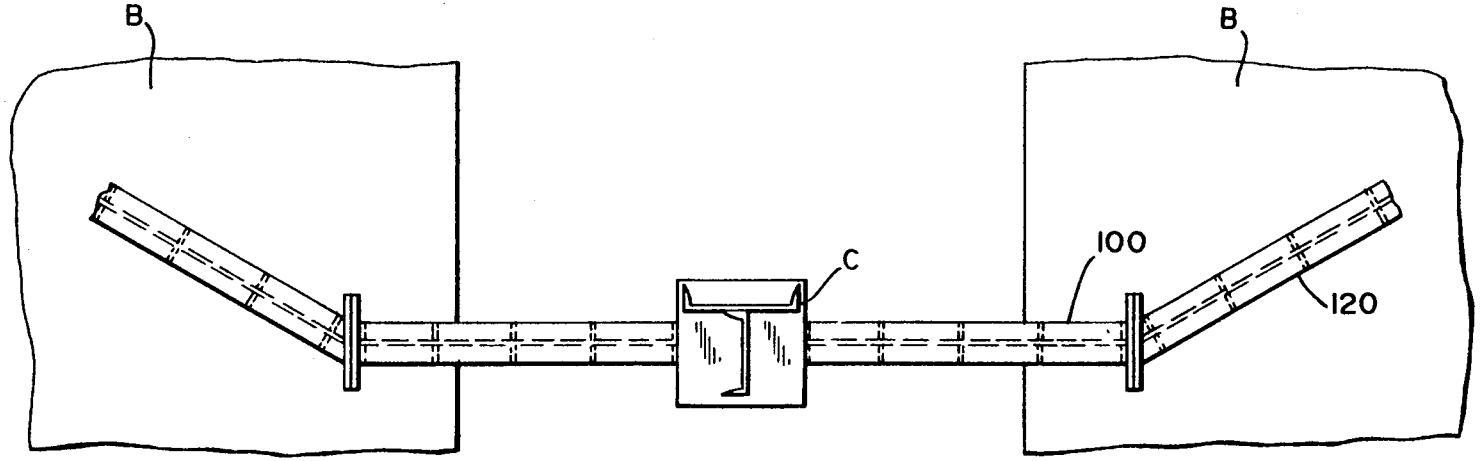

In FIG. 5 it can be seen how lifting device 50 lifts reinforced U-shaped support structure 100 which in turn lifts tank bottom B. Tank bottom B is welded to longitudinally extending flat bottom surface 122. The support apparatus 100 from each column C are interconnected to each other through rail members 120. For the central column the support structure 100 is connected to rail members 120' as shown in FIG. 5-A. The only difference being the angle of connection between the rail member and the U-shaped supporting structure.

The underside of rail members 120 and 120' are welded to bottom B at several points, spaced apart from each other. A sufficient number of welded spots insure that rail members 120 and 120' will not separate from bottom B. Flat end surfaces 124 are rigidly mounted at the ends of rail members 120 and 120' and they are perpendicularly disposed with respect to longitudinally extending flat bottom surface 122. Flat end surfaces 124 are rigidly mounted (welded) to the lowermost termination of vertical reinforced support members 102. Elongated reinforced horizontal support member 104 overlies over the uppermost terminations of elongated vertical reinforced members 102 and they are welded to each other. In this manner, lifting device 50 will transmit its lifting force through compression to column C and bottom B will be lifted through a pulling force exerted through vertical reinforced members 102 and rail members 120 and 120'. To further enhance the mechanical and structural stability of U-shaped support structure 100, stiffener members 106 are provided and are cooperatively rigidly mounted (welded) under horizontal reinforced member 104 and adjacent to vertical member 102.

Figure 8:
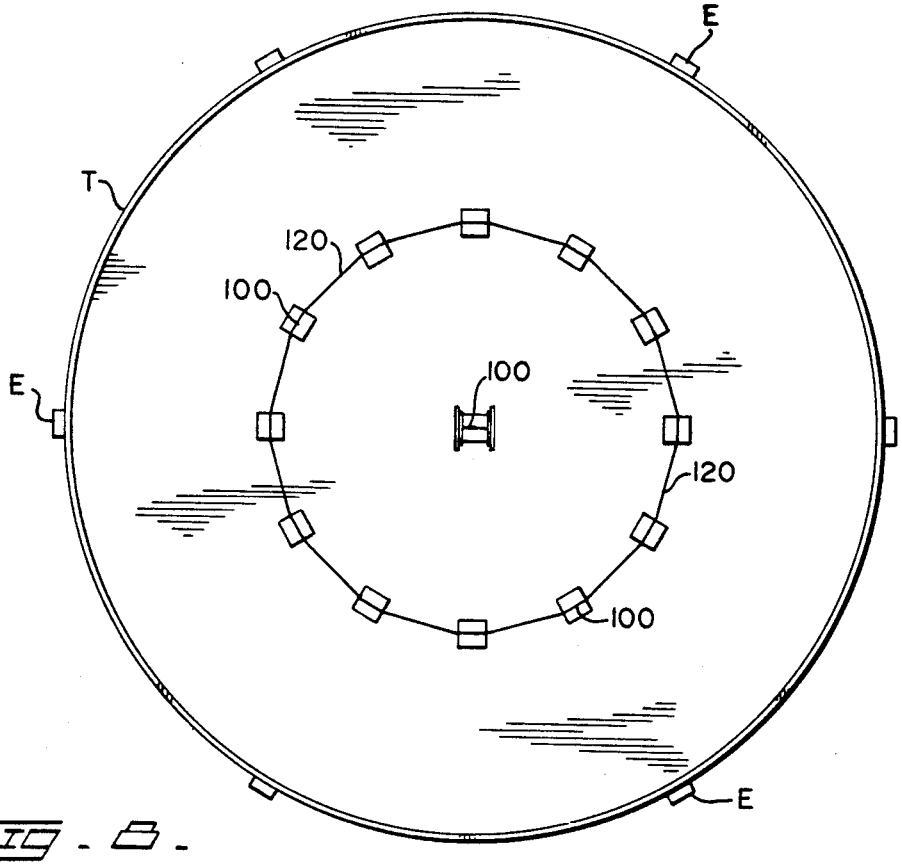
FIG. 8 is a top view of part of the support structure represented in FIG. 7.

As it can be seen from FIG. 8, the U-shaped structure 100 from each column C are interconnected and the exterior lifting apparatus E, as taught in said U.S. Pat. Nos. 4,807,851 and 4,930,750 can be used to simultaneously lift the tank.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for lifting tanks off the surface where they rest and tanks having a bottom, a roof and outer peripheral wall and internal supporting columns resting on said bottom and supporting said roof comprising:

A. plurality of reinforced C-shaped support structure having an elongated horizontal reinforced support member including two ends and two substantially equal elongated vertical reinforced support members each having two terminations and said elongated horizontal support member overlying over terminations of each of said elongated vertical reinforced support members and rigidly mounted thereto;

B. elongated rail means having a longitudinally extending flat bottom surface that is rigidly mounted to the bottom of said tanks and said elongated rail means further having two ends with flat end surfaces perpendicular to said flat bottom surface and one of said flat end surfaces being rigidly mounted to the lowermost termination of said vertical reinforced support members of one of said C-shaped support structure and other flat end surface being rigidly mounted to the lowermost termination of said vertical reinforced support member of an adjacent C-shaped support structure and;

C. lifting device engaging said elongated horizontal reinforced support member.

2. The apparatus set forth in claim 1 further including stiffener members cooperatively mounted below said elongated horizontal reinforced support members and adjacent to said vertical reinforced support member so that the mechanical and structural integrity of said C-shaped support structure is enhanced.

3. The apparatus set forth in claim 2 wherein said longitudinally extending flat bottom surface is welded to said tank bottom at predetermined spaced apart points.

* * * * *